United States Patent [19]

Pasini

[11] 3,934,257

[45] Jan. 20, 1976

[54] NON-IMPACT PRINTER

[75] Inventor: Arnaldo Pasini, Ivrea, Italy

[73] Assignee: Ing. C. Olivetti & C., S.p.A., Ivrea (Torino), Italy

[22] Filed: Aug. 26, 1974

[21] Appl. No.: 500,826

[30] Foreign Application Priority Data

Aug. 28, 1973 Italy ..... 69571/73

[52] U.S. Cl. ..... 354/5; 354/9

[51] Int. Cl.[2] ..... B41B 13/00

[58] Field of Search ..... 354/5–19

[56] References Cited

UNITED STATES PATENTS 3,006,259 10/1961 Blakely ..... 354/9

3,076,393 2/1963 Campbell ..... 354/5

*Primary Examiner*—John M. Horan

*Attorney, Agent, or Firm*—I. J. Schaefer

[57] ABSTRACT

A non-impact printing system in which a photoconductor is illuminated with a light image of the character to be printed while applying a voltage across the photoconductor and a transparent insulating belt held in contact with the illuminated portion of the photoconductor. This results in the depositing of a latent electrostatic image of the character on the surface of the belt in contact with the photoconductor layer. The belt is then transported past a developing station where the image is developed with a toner and then transferred to plain paper.

11 Claims, 7 Drawing Figures

NON-IMPACT PRINTER

BACKGROUND OF THE INVENTION

This invention relates generally to non-impact printing apparatus and more particularly to non-impact printing apparatus suitable for use in typewriters and word processing systems.

Present day typewriters and word processing systems which print by the ballistic impact of type bearing members against an inked ribbon and the paper being printed upon have inherent speed limitations caused by the necessity of mechanically actuating the type bearing members to strike the paper and ink carrying ribbon. The mechanical complexity of the machine result in a reliability lower than than which could be obtained in an electronic system and the speed obtainable, while acceptable for use with a human typist, is too low for an efficient operation when the machine is being driven by an electronic input such as a computer. The ballistic impact typewriter is also an inherently noisy machine and, especially in word processing applications, produces noise levels which are almost intolerable in confined areas.

Non-impact printing systems have not been suitable for applications in the typewriter or word processing area since they generally either require coated paper, print matrix type characters, require a very expensive printing mechanism, do not permit character by character visibility and/or generate a print quality which is too low for these applications.

SUMMARY OF THE INVENTION

In order to overcome these and other disadvantages of prior art printing systems Applicant provides a non-impact printing apparatus which is capable of generating fully shaped characters on plain paper and which can be implemented inexpensively. In accordance with his invention Applicant illuminates a photoconductor with a light image of the character to be printed while applying a voltage across the photoconductor and a transparent insulating belt held in contact with the illuminated portion of the photoconductor. This results in the deposition of a latent electrostatic image of the character on the surface of the insulating belt in contact with the photoconductive layer. The belt is then transported past a developing station where the latent image is developed with a toner and into a viewing station where the developed character may be viewed through the transparent insulating belt by an operator. The belt is moved incrementally so that a line of characters may be deposited and developed thereon. A line of characters is then transferred to a sheet of plain paper and the paper is advanced by a one line increment for the printing of the next line of information.

DETAILED DESCRIPTION

Figure 1:
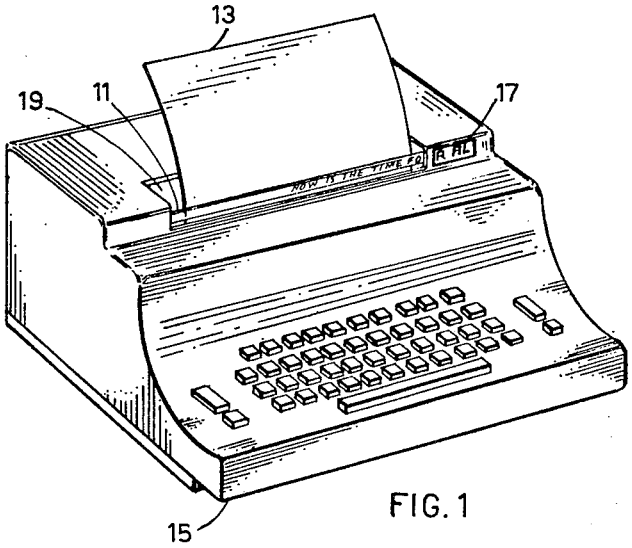
FIG. 1 is a front view of a non-impact typewriter according to a preferred embodiment of the invention.

Referring now to FIG. 1 of the drawings there is illustrated a typewriter according to a preferred embodiment of the invention in which a transparent tape 11 of an insulating material such as polyethylene terephthalate is incrementally transported across the paper 13 being printed upon as the operator enters the information on the keyboard 15. As will be described in more detail in the description of the subsequent figures, toner images of the characters entered on the keyboard 15 are deposited on the face of the belt 11 toward the paper 13. The toner images are generated by serially forming latent electrostatic images of the characters on the belt 11 and then developing them with a toner. Character by character visibility of the information being entered on the keyboard by the operator is obtained from the fact that the belt 11 is transparent so that the toner characters deposited on its interior face are visible to the operator through the belt 11. The last four characters entered, which have not yet been developed on the tape 11, appear on the display 17 which is aligned with the belt 11 at the right hand side of the carriage 19 of the typewriter.

After the operator has typed a line of information, the depression of the carriage return key causes the advance of the tape 11 in order to develop the last four characters and to move the line of information on the tape 11 into registry with the paper 13 and the line of information previously recorded thereon. The developed toner images may be then transferred from the tape 11 to the paper 13 by a suitable method such as by pressure, electrostatic or magnetic assisted transfer or a combination of them. After the transfer of the toner, the paper 13 is advanced by one line space for the printing of the next line.

Figure 2:
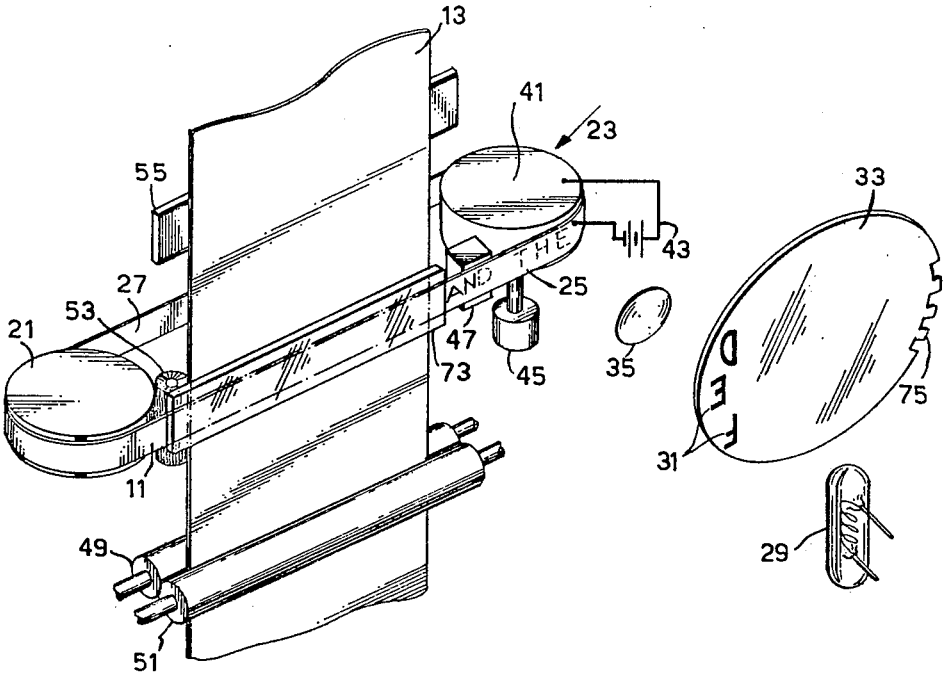
FIG. 2 is a simplified illustration of a preferred embodiment of the non-impact printing system of the invention.

Referring now to FIG. 2 of the drawings, the endless transparent dielectric belt 11 is tracked over the roller 21 and the photoconductive material coated roller 23. The paper 13 being printed upon is disposed between the forward and rear portions 25 and 27 of the belt 11.

The photoconductive material coated roller 23 may include a roller having a conductive peripheral surface and a coating of photoconductive material deposited thereon. The roller may, for instance, be made of a plastic with a conductive peripheral coating or of aluminium. The photoconductive coating material may be any one of the well known photoconductive materials such as selenium, cadmium sulphide, zinc oxide or an organic photoconductor. For reasons of resistance to wear and abrasion, however, it is preferred to use ceramic type photoconductors which have recently been introduced.

The photoconductive material coated roller 23 is imaged by light from flash lamp 29 which projects light through transparent character shaped areas 31 distributed circumferentially about the rotating opaque character wheel 33. The lens 35 focuses the image light from the flash lamp 29 which is collimated by a selected transparent character shaped area 31 onto a predetermined portion of the photoconductive coating on the roller 23 through the transparent belt 11.

Figure 3:
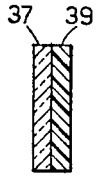
FIG. 3 is a cross sectional view of the transparent dielectric belt used in the preferred embodiment of the printing system according to the invention.

The transparent belt 11 which is shown in cross-section in FIG. 3 of the drawings may be made up of a transparent dielectric layer 37 which is disposed adjacent to the rollers 21 and 23 and a transparent conductive coating 39 on the face of the belt 11 away from the rollers 21 and 23. As stated above the layer of dielectric material 37 may be formed of a plastic material such as transparent polyethylene terephthalate, which is sold under the trademark Mylar, while the transparent conductive coating 39 may be a layer of transparent conductive polyethylene coated on the mylar.

In order to deposit a latent electrostatic image on the interior dielectric face of the belt 11, a potential is applied between the conductive central portion 41 of the photoconductive material coated roller 23 and the conductive coating 39 on the belt 11 by means illustrated generally as a battery 43. The image light passing through a selected character shaped transparent area 31 on the rotating wheel 33 is focused on the photoconductive coating on the roller 23 and causes that portion of the photoconductive coating to become conductive. This results in a transient current flow between the conductive central portion 41 of the roller 23 and the conductive coating 39 on the belt 11 thereby depositing charge in image configuration on the interior dielectric face of the belt 11.

The belt 11 is incrementally advanced by single character spaces by means of the stepping motor 45, which is coupled to the photoconductive material coated roller 23. Subsequent character shaped latent images may be deposited on the interior dielectric face of the belt 11 in the same manner as described above thereby allowing the operator to enter a full line of information on the belt 11 from the keyboard 15 (FIG. 1).

The latent character shaped images on the belt 11 are developed by means of a developer unit 47 disposed immediately to the left of the roller 23. The developer unit 47 may, for instance, consist of a small magnetic brush which deposits dry toner particles on the latently imaged portions of the interior dielectric face of the belt 11. The developer unit 47 is located immediately to the right of the point of which the belt becomes visible to the operator at the right hand side of the carriage 19 (FIG. 1). Thus the operator can directly view the characters on the belt 11 which have been developed by the developer unit 47 and can view those characters which have been entered on the keyboard 15 but not yet developed on the display 17.

After the operator has entered a line of characters on the belt 11 in the same manner as information is entered on the keyboard of a traditional typewriter the return key is depressed. This causes the belt 11 to advance by an amount sufficient to develop the remaining latently imaged characters on the belt 11 and to bring the line of information into registry with previously entered lines on the paper 13. The toned characters on the belt 11 are transferred to the paper 13 by means which will be described subsequently in relation to FIGS. 6 and 7 of the drawings. Immediately after the transfer of the line of information to the paper 13, the paper 13 is line spaced by paper feed rollers 49 and 51. The rotation of roller 49 may be controlled in the illustrated embodiment of the invention, by a stepping motor (not shown) in order to advance the paper 13 by a preselected line spacing. The roller 51 is biased toward the roller 49 to maintain the paper 13 in contact therewith. After the transfer and line spacing operations the operator can begin to enter the next line of information from the keyboard onto the next portion of the belt 11. Residual toner left on the belt 11 may be removed by a brush 53.

The toner is fused on the paper 13 by means of the fusing unit 55 which may comprise a heated platen over which the paper 13 passes after being imaged by the belt 11.

Figure 4:
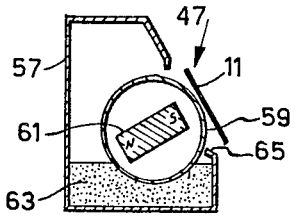
FIG. 4 is a side cut away view of the magnetic brush developer used in the printing system of FIG. 2.

As seen in FIG. 4, the magnetic brush developer unit 47 may include a toner resevoir 57 in which is disposed a rotatable magnetic brush cylinder 59. A magnet 61 is disposed within the rotatable cylinder 59 and is fixed with respect to resevoir 57. The developer unit 47 operates in a well known manner with the cylinder 59, which rotates in the counter clockwise direction as seen in FIG. 4, picking up developer from the dry developer bath 63 and carrying it into contact with the electrostatic latent image on the belt 11. A doctor blade 65 is mounted on the lower portion of the developer resevoir 57 in order to regulate the thickness of the layer of developer material carried by the cylinder 65 to the belt 11.

It is preferred that the developer material 63 be a single component powdered magnetic toner rather than a mixture of non-magnetic toner with iron filings. As is known in the art, the use of such a single component developer eliminates the problems associated with replenishing the developer with a concentrate in order to maintain the proper proportion between iron filings and toner particles. It also greatly reduces the wear on the belt 11 caused by the abraiding effect on the iron filings. Such a single component magnetic developer have recently become available from a number of toner suppliers.

Figure 5:
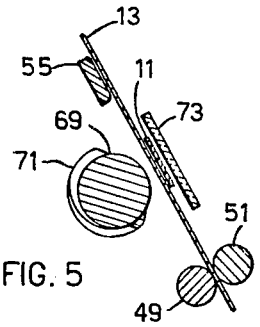
FIG. 5 is a simplified side view of the toner transfer system of the embodiment of the invention illustrated in FIG. 2.
Figure 6:
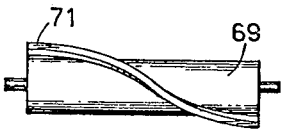
FIG. 6 shows the transfer cylinder of FIG. 5.

As stated above, the transfer of the toner from the dielectric face of the belt 11 to the paper 13 may be accomplished in any one of several well known ways. As seen in FIGS. 5 and 6 of the drawings, the illustrated embodiment of the invention makes use of a transfer roller 69 having a helical pressure blade 71. In order to transfer the toner from the belt 11 to the paper 13 an image configuration, the transfer roller 69 is rotated through one cycle in a clockwise direction as seen in FIG. 5 thereby causing the blade 71 to press the paper 13 into contact with the belt 11. A transparent pressure plate 73 may be provided opposite the transfer roller on the other side of the paper 13 and belt 11 to increase the pressure between the paper 13 and the web 11 in order to transfer more of the toner. After the toner is transferred by the action of the pressure blade 71 the paper 13 is line spaced by means of paper feeding rollers 49 and 51 and the toner image on the paper is fused by heated platen 51. It should, of course, be apparent that the transfer roller 69 and transparent pressure plate 73 could be replaced with a transfer carona of well-known design.

Figure 7:
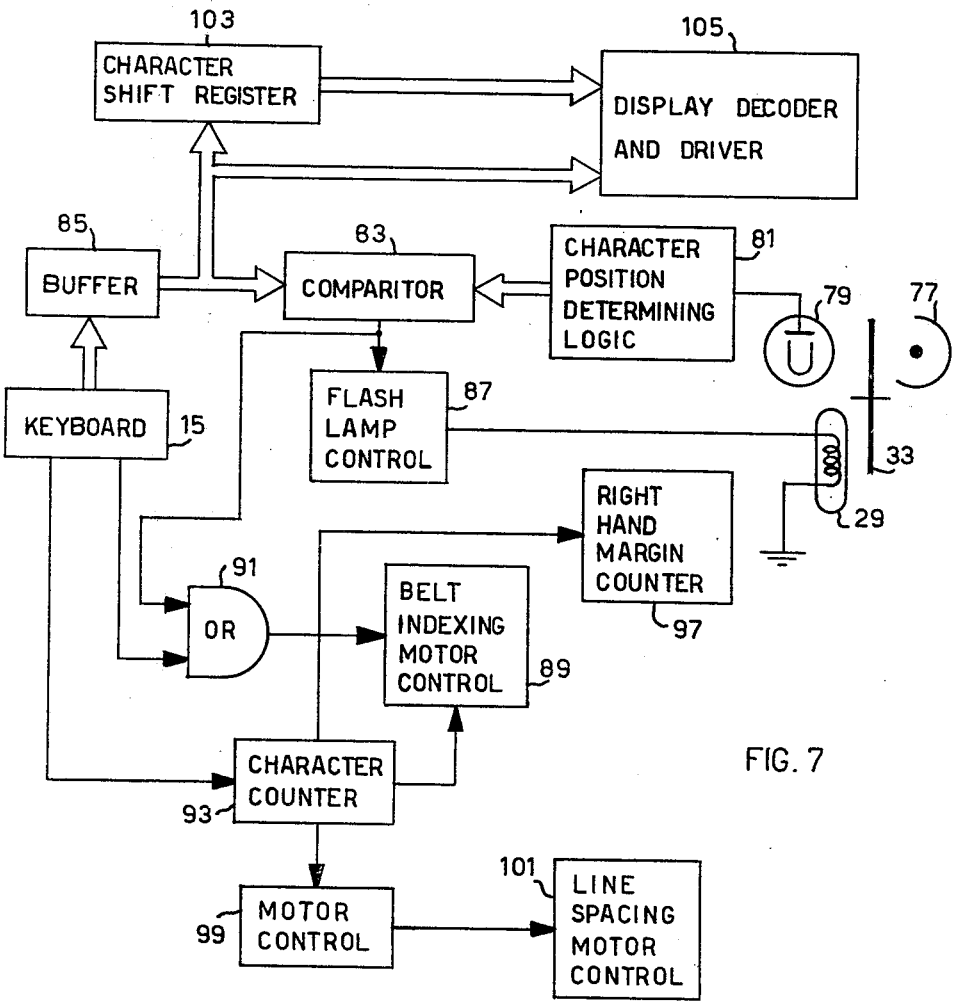
FIG. 7 is a schematic block diagram of the circuitry and to control the non-impact printing system of FIGS. 1 and 2.

Referring now to FIGS. 2 and 7 of the drawings, the periphery of the rotating character wheel 33 may be encoded, for instance, by means of notches or slots 75, in order to allow the determination of which of the transparent character shaped areas 31 is positioned between the flash lamp 29 and the lens 35 at any given time. This encoding may, in the illustrated embodiment of the invention, be read by sensing by a photocell 79 the sequence of pulses of light transmitted through the encoded notches or slots 75 in the periphery from a light source 77 positioned opposite the photocell 79 on the other side of the character wheel 33. The output of the photocell 79 is connected to the character position determining logic 81. The logic determines which of the transparent character shaped areas 31 is in position for printing at any given time and transmits to the comparator 83 a code identifying this character.

When the operator depresses a character key on the keyboard 15 the code of the character is loaded into the buffer 85 whose output is connected to the comparator 83. When the comparator 83 senses a coincidence between the character code in the buffer 85 and the output of the character position determining logic 81 it generates an output signal to the flash lamp 29. The light from the flash lamp 29 projects a light image of the character entered on the keyboard to the photoconductive material coated roller 23 thereby causing deposition of electrostatic charge in image configuration on the dielectric face of the belt 11. In the illustrated embodiment of the invention the flash lamp 29 may consist of a zenon flash.

The output of the comparator 83 also energizes the stepper motor control circuit 89 through OR gate 91 which causes the stepper motor 45 to index the roller 23 and web 11 by one character space. The response time of the stepper motor 45 is such that the imaging of the belt 11 is completed before the indexing movement begins. When the operator depresses the character space bar the keyboard signals the belt indexing motor control circuit 89 through the OR gate 91 to advance the belt 11 by one character space.

The output of the OR gate 91 is also connected to the character counter 91 which counts the number of characters and character spaces entered in a line by the operator on the keyboard 15. A carriage return or end of line key output from the keyboard 15 is also connected to the character counter 93 by line 95. When the return key is actuated it causes the character counter 93 to control the belt indexing motor control circuit 89 to index the motor 45 a number of times sufficient to being the left end of the line of information printed on the belt 11 into registry with a left hand margin on the paper 13.

The character counter 93 may have a capacity equal to the number of character spaces between the point on the belt 11 being imaged by light from flash lamp 29 (FIG. 1) and the left most permissable left hand margin location on the carriage 19 (FIG. 1). The left hand margin may be set by the operator to a desired location. The setting of the left hand margin operates to enter an initial count into the character counter 93. Each character or character space entered by the operator on the keyboard acts to increment the counter 93 and cause the motor 45 to index the belt 11. When the return key is pressed, the character counter 93 is activated so that it counts independently and causes the motor 45 to index the belt 11 once for each count through the belt indexing motor control 89. When the counter 93 overflows the left most character on the belt 11 is in registry with the left hand margin on the paper 13 and line is in position for transferring.

A right hand margin counter 97 is provided which has a capacity equal to that of the maximum number of characters and spaces which may be entered on a single line. An initial count determined by the setting of the right and left hand margins is entered into the counter 97 which is then incremented each time a character or a space is entered on the keyboard 15. If the counter 97 overflows, it thereby indicates that a number of characters and spaces corresponding to the maximum selected line length has been entered on the belt 11. The overflow of the counter 93 may therefore be used to generate a signal to the operator and, if desired, to prevent the entering of further characters or spaces on the keyboard 15.

The overflow signal from the character counter 93 is connected to the transfer motor control circuit 99 which causes the transfer motor (not shown) to drive the transfer roller 69 through a single cycle of rotation. This causes the helical pressure blade 71 to press the paper 13 into contact with the belt 11 for transferring the toner image to the paper 13. When the transfer cylinder 69 has completed its rotation the transfer motor control circuit 99 energizes the line spacing motor control circuit 101 to index the paper 13 by one line space by means of the paper feeding rollers 49 and 51.

In order to drive the display 17 the output of the buffer 85 is also connected to a three character shift rgister 103. Each time the operator enters a character on the keyboard 15, the previous contents of the buffer 85 are loaded into the first character stage of the shift register 103, thereby shifting the previous contents of the shift register by one place. The buffer 85 and the shift register 103 therefore contains the last four characters entered by the operator and are connected to the display decoder and driver 105 in order to drive the display 17.

It should be apparent that while the illustrated embodiment of the invention uses individual motors for each of the belt, paper and pressure cylinder moving operation, this is merely a question of design and that some or all of these functions could be performed by a single source of motive power coupled by appropriate gears and clutches to the various parts of the machine.

What is claimed is:

1. Non-impact printing apparatus for printing on plain paper comprising:

a photoconductive element including a roller having a photoconductive peripheral surface;

a transparent belt having an insulating surface tracked over said roller and wherein a portion of said insulating surface is in contact with an area of said photoconductive element;

means for incrementally transporting said belt in a path from said roller across said paper with said insulating surface facing said paper;

means for sequentially exposing said photoconductive surface at said area to light images of the characters to be printed on said paper;

means for applying a voltage across said photoconductive surfaces and said portion of said transparent belt in contact therewith during the exposure of said element to said light images, said transporting means incrementing said belt after each exposure to the light image of a character for forming on said belt the electrostatic latent image of a line of characters to be printed on said paper;

developing means disposed between said roller and said paper for developing the latent images on said belt with a toner, the line of toner developed characters being visible through said transparent belt;

means for transferring said line of toner developed characters from said belt to said paper; and means for line spacing said paper.

2. The non-impact printing apparatus of claim 1 wherein said means for sequentially exposing includes means for projecting light images of the characters to be printed through said transparent belt onto said area of said photoconductive surface of said roller.

3. The non-impact printing apparatus according to claim 2 wherein said light projecting means includes:

a light source;

means for collimating light from said light source into character shapes;

a lens for focusing said collimated light onto said photoconductive surface through said transparent belt.

4. The non-impact printing apparatus of claim 1 further including means for removing excess toner from said belt after the transfer of said toner developed characters from said belt to said paper.

5. The non-impact printing apparatus of claim 1 further including a fusing element for fusing the toner on said paper after said paper is line spaced.

6. Non-impact printing apparatus for printing on plain paper comprising:

a photoconductive element including a layer of photoconductive material on a conductive substrate;

a transparent belt having a transparent insulating layer and a transparent conductive coating on said layer, a portion of said insulating layer being in contact with an area of said photoconductive layer;

means for incrementally transporting said belt in a path from said photoconductive element across said paper with said insulating surface facing said paper;

means for sequentially exposing said photoconductive element at said area to light images of the characters to be printed on said paper;

means for applying a voltage between said conductive substrate of said photoconductive element and the conductive coating of said portion of said transparent belt in contact therewith during the exposure of said element to said light images, said transporting means incrementing said belt after each exposure to the light image of a character for forming on said belt the electrostatic latent image of a line of characters to be printed on said paper;

developing means disposed between said photoconductive element and said paper for developing the latent images on said belt with a toner, the line of toner developed characters being visible through said transparent belt;

means for transferring said line of toner developed characters from said belt to said paper; and means for line spacing said paper.

7. The non-impact printing apparatus of claim 6 further including means for removing excess toner from said belt after the transfer of said toner developed characters from said belt to said paper.

8. The non-impact printing apparatus of claim 6 further including a fusing element for fusing the toner on said paper after said paper is line spaced.

9. Non-impact printing apparatus for printing on plain paper comprising:

a keyboard for entering characters to be printed;

a photoconductive element;

a transparent belt having an insulating surface, a portion of said insulating surface being in contact with an area of said photoconductive element;

means for incrementally transporting said belt in a path from said photoconductive element across said paper from right to left with said insulating surface facing said paper;

means for sequentially exposing said photoconductive element at said area to light images of the entered characters to be printed on said paper;

means for applying a voltage across said photoconductive element and said portion of said transparent belt in contact therewith during the exposure of said element to said light images, said transporting means incrementing said belt after each exposure to the light image of a character for forming on said belt the elecrostatic latent image of a line of characters to be printed on said paper;

developing means disposed between said photoconductive element and said paper for developing the latent images on said belt with a toner, the line of toner developed characters being visible through said transparent belt;

means for transferring said line of toner developed characters from said belt to said paper;

means for line spacing said paper; and display means located over the area between the point where said belt is imaged by said exposing means and the point at which said latent electrostatic images on said belt become developed by said toner for displaying the undeveloped characters on said belt entered by said keyboard.

10. The non-impact printing apparatus of claim 9 further including means for removing excess toner from said belt after the transfer of said toner developed characters from said belt to said paper.

11. The non-impact printing apparatus of claim 9 further including a fusing element for fusing the toner on said paper after said paper is line spaced.

* * * * *